US011685979B2

(12) United States Patent
Larsson et al.

(10) Patent No.: US 11,685,979 B2
(45) Date of Patent: Jun. 27, 2023

(54) IRON BASED POWDER

(71) Applicant: HÖGANÄS AB (PUBL), Höganäs (SE)

(72) Inventors: Caroline Larsson, Nyhamnsläge (SE); Ulf Engström, Höganäs (SE); Christophe Szabo, Ratingen (DE)

(73) Assignee: HÖGANÄS AB (PUBL), Höganäs (SE)

( * ) Notice: Subject to any disclaimer, the term of this patent is extended or adjusted under 35 U.S.C. 154(b) by 1094 days.

(21) Appl. No.: 16/087,377

(22) PCT Filed: Mar. 15, 2017

(86) PCT No.: PCT/EP2017/056123
§ 371 (c)(1),
(2) Date: Sep. 21, 2018

(87) PCT Pub. No.: WO2017/162499
PCT Pub. Date: Sep. 28, 2017

(65) Prior Publication Data

US 2021/0046543 A1 Feb. 18, 2021

(30) Foreign Application Priority Data

Mar. 23, 2016 (EP) ..... 16161814

(51) Int. Cl.
*B22F 1/05* (2022.01)
*B22F 3/16* (2006.01)
(Continued)

(52) U.S. Cl.
CPC ..... *C22C 33/0264* (2013.01); *B22F 1/05* (2022.01); *B22F 1/052* (2022.01); *B22F 1/06* (2022.01);
(Continued)

(58) Field of Classification Search
None
See application file for complete search history.

(56) References Cited

U.S. PATENT DOCUMENTS

2010/0054982 A1* 3/2010 Larsson ..... B22F 1/025 419/36
2010/0154588 A1* 6/2010 Berg ..... B22F 1/0059 75/246
(Continued)

FOREIGN PATENT DOCUMENTS

AU 2017236260 B2 10/2018
CN 101680063 A 3/2010
(Continued)

OTHER PUBLICATIONS

International Search Report (PCT/ISA/210) dated Jun. 16, 2017, by the European Patent Office as the International Searching Authority for International Application No. PCT/EP2017/056123.
(Continued)

*Primary Examiner* — Xiaobei Wang
(74) *Attorney, Agent, or Firm* — Buchanan Ingersoll & Rooney P.C.

(57) ABSTRACT

Disclosed is a new diffusion-bonded powder consisting of an iron powder having 1-5%, preferably 1.5-4% and most preferably 1.5-3.5% by weight of copper particles diffusion bonded to the surfaces of the iron powder particles. The new diffusion bonded powder is suitable for producing components having high sintered density and minimum variation in copper content.

10 Claims, 3 Drawing Sheets

Figure 1:
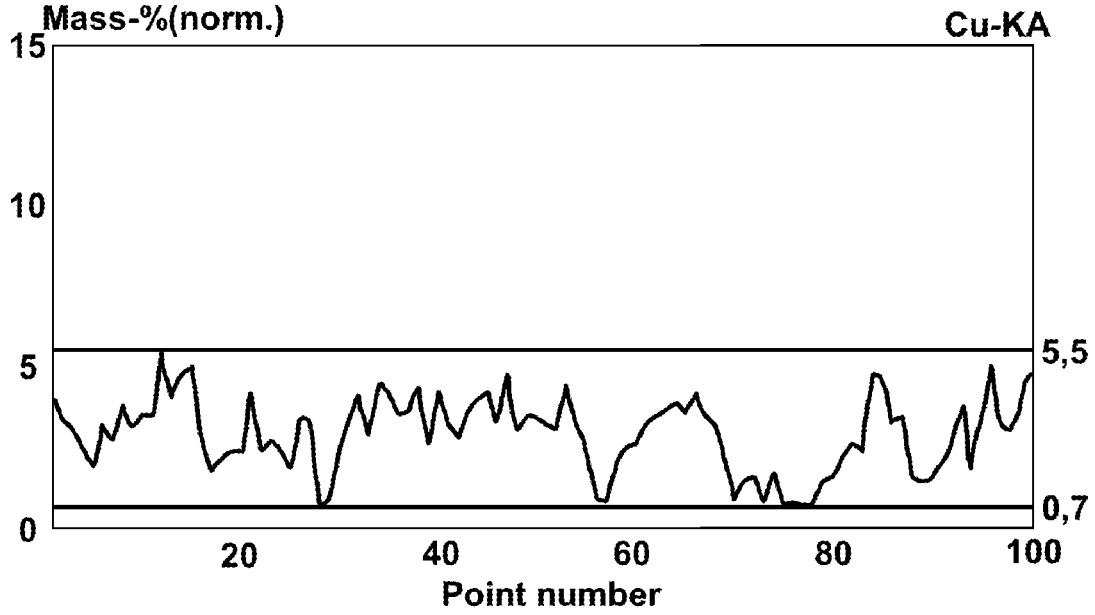

(51) Int. Cl.

| | |
|---|---|
| ***B22F 3/24*** | (2006.01) |
| ***B22F 9/04*** | (2006.01) |
| ***C22C 33/02*** | (2006.01) |
| ***B22F 1/10*** | (2022.01) |
| ***B22F 1/16*** | (2022.01) |
| ***B22F 1/052*** | (2022.01) |
| ***B22F 1/17*** | (2022.01) |
| ***B22F 1/06*** | (2022.01) |

(52) U.S. Cl.

CPC ..... *B22F 1/10* (2022.01); *B22F 1/17* (2022.01); *B22F 3/16* (2013.01); *B22F 3/24* (2013.01); *B22F 9/04* (2013.01); *C22C 33/0235* (2013.01); *B22F 2003/248* (2013.01); *B22F 2301/35* (2013.01); *B22F 2302/25* (2013.01); *Y10T 428/12014* (2015.01); *Y10T 428/12611* (2015.01)

(56) References Cited

U.S. PATENT DOCUMENTS

| | | | | |
|---|---|---|---|---|
| 2011/0252922 | A1* | 10/2011 | Larsson | C22C 9/06 75/243 |
| 2016/0114392 | A1* | 4/2016 | Berg | C22C 38/04 419/39 |
| 2018/0193911 | A1* | 7/2018 | Kobayashi | C22C 38/12 |
| 2021/0046543 | A1 | 2/2021 | Larsson et al. | |

FOREIGN PATENT DOCUMENTS

| | | | |
|---|---|---|---|
| CN | 102554220 | A | 7/2012 |
| EP | 3433392 | B1 | 1/2019 |
| GB | 1162702 | A | 8/1969 |
| GB | 1595346 | A | 8/1981 |
| JP | H01-290702 | A | 11/1989 |
| JP | H06-86605 | B2 | 11/1994 |
| JP | H08-92604 | A | 4/1996 |
| JP | 09-095701 | A | 4/1997 |
| JP | H1096001 | A | 4/1998 |
| JP | 2003-339902 | A | 12/2003 |
| JP | 3918236 | B2 | 5/2007 |
| JP | 2010-529302 | A | 8/2010 |
| JP | 7113754 | B2 | 8/2022 |
| KR | 1020060134220 | A | 12/2006 |
| KR | 1020090104081 | A | 10/2009 |
| KR | 20100020039 | A | 2/2010 |
| KR | 1020140083164 | A | 7/2014 |
| RU | 1828421 | A3 | 7/1993 |
| RU | 2327547 | C1 | 6/2008 |
| WO | 2005102565 | A1 | 11/2005 |
| WO | 2008059855 | A1 | 5/2008 |
| WO | 2010062250 | A1 | 6/2010 |
| WO | 2017162499 | A1 | 9/2017 |

OTHER PUBLICATIONS

Written Opinion (PCT/ISA/237) dated Jun. 16, 2017, by the European Patent Office as the International Searching Authority for International Application No. PCT/EP2017/056123.

Office Action and Written Opinion (Notification of Reason for Refusal) dated Jun. 28, 2021, by the Korean Patent Office in corresponding Korean Patent Application No. 10-2018-7029255, and an English Translation of the Office Action. (18 pages).

Office Action (Third Office Action) dated Jul. 14, 2021, by the China National Intellectual Property Administration in corresponding Chinese Patent Application No. 201780017815.2, and an English Translation of the Office Action. (21 pages).

Office Action dated Jul. 10, 2021, by the Intellectual Property India, Government of India in corresponding Indian Patent Application No. 201817034055, and an English Translation of the Office Action. (7 pages).

Office Action (Examinnation Report No. 1 for standard patent application) dated Oct. 15, 2021 by the Australian Government—IP Australia in corresponding Australian Patent Application No. 2017236260, (2 pages).

Office Action dated Jul. 8, 2021, by the Federal Public Service Ministry of Economy National Institute of Industrial Property in Brazilian Patent Application No. BR112018069230-1 and an English Translation of the Office Action. (9 pages).

Office Action of substantive examination dated Apr. 24, 2020, by the Federal Service for Intellectual Property (FIIP) in Russian Patent Application No. 2018137052/05(061381), and an English Translation of the Office Action. (17 pages).

Office Action (Decision of Rejection) dated Nov. 24, 2021, by the Japanese Patent Office in corresponding Japanese Patent Application No. 2018-549921, and an English Translation of the Office Action. (5 pages).

Office Action (Rejection Decision) dated Nov. 18, 2021, by the Chinese Patent Office in corresponding Chinese Patent Application No. 201780017815.2, and an English Translation of the Office Action. (19 pages).

Notice of Allowance dated Mar. 2, 2022, by the Intellectual Property Office in corresponding Korean Patent Application No. 10-2018-7029255, and an English Translation of the Office Action. (3 pages).

Office Action dated Jun. 24, 2022, in Brazilian Patent Application No. BR112018069230-1, English Version of the Unfavourable Opinion, (3 pages).

Office Action dated Dec. 15, 2022, by the Canadian Intellectual Property Office in Canadian Patent Application No. 3,017,996 (5 pages).

* cited by examiner

IRON BASED POWDER

CROSS-REFERENCE TO RELATED APPLICATIONS

This application is a national stage of international application no. PCT/EP2017/056123, filed on Mar. 15, 2017, and claims the benefit of priority under 35 USC 119 of EP application no. 16161814.5, filed on Mar. 23, 2016, both of which are incorporated herein by reference in their entirety.

FIELD OF THE INVENTION

The present invention relates to an iron based powder intended for the powder metallurgical manufacturing of components. The invention further relates to a method of manufacturing the iron based powder and a method for manufacturing a component from said iron based powder and an accordingly produced component.

BACKGROUND

In industry the use of metal products manufactured by compacting and sintering iron-based powder compositions is becoming increasingly widespread. The quality requirements of these metal products are continuously raised, and as a consequence, new powder compositions having improved properties are developed. Beside density, one of the most important properties of the final, sintered products is the dimensional change, which above all have to be consistent. Problems with size variations in the final product often originates from inhomogenities in the powder mixture to be compacted. Such inhomogenities may also lead to variations in mechanical properties of the final components. These problems are especially pronounced with powder mixtures including pulverulent components, which differ in size, density and shape, a reason why segregation occurs during handling of the powder composition. This segregation implies that the powder composition will be non-uniformly composed, which in turn means that parts made of the powder composition exhibits varying dimensional change during its production and the final product will have varying properties. A further problem is that fine particles, particularly those of lower density such as graphite, cause dusting in the handling of the powder mixture.

Differences in particle size also create problems with the flow properties of the powder, i.e. the capacity of the powder to behave as a free-flowing powder. An impaired flow manifests itself in increased time for filling dies with powder, which means lower productivity and an increased risk of variations in density and composition of the compacted component, which may lead to unacceptable deformations after sintering.

Attempts have been made at solving the problems described above by adding various binding agents and lubricants to the powder composition. The purpose of the binder is to bind firmly and effectively the small size particles of additives, such as alloying components, to the surface of the base metal particles and, consequently, reduce the problems of segregation and dusting. The purpose of the lubricant is to reduce the internal and external friction during compaction of the powder composition and also reduce the ejection force, i.e. the force required to eject the finally compacted product from the die.

The most commonly employed powder compositions for manufacturing of components by compaction and sintering contains iron, copper and carbon, as graphite, in powder form. In addition, a powdered lubricant is also normally added. The content of copper is normally between 1-5% by weight of the composition, the content of graphite between 0.3-1.2% by weight and the content of lubricant is normally below 1% by weight.

The alloying element carbon, as graphite, is normally present as discrete particles in the powder which particles may be bonded to the surface of the coarser, low carbon containing, iron—or iron based powder in order to avoid segregation and dusting. The option of adding carbon as a pre-alloyed element in the iron or iron based powder, i.e. added in the melt before atomization, is not an alternative as such high carbon containing iron or iron-based powder would be too hard and extremely difficult to compact.

The alloying element copper may be added in elemental form as a powder and optionally bonded to the iron or iron based powder by means of a binder. A more efficient alternative to avoid e.g. copper segregation and copper dusting is however to diffusion bond, partially alloy, copper particles to the surface of the iron or iron based powders. By this method an unacceptable increase of the hardness of the iron or iron-based powder is avoided which otherwise would be a consequence if copper was allowed to be totally alloyed, pre-alloyed, to the iron or iron-based powder.

Diffusion bonded powders where copper is diffusion bonded to the surface of the iron or iron-based powder have been known for decades. In the GB patent GB1162702, 1965, (Stosuy) a process for preparing a powder is disclosed. In this process alloying elements are diffusion-bonded, partially alloyed, to the iron powder particles. An unalloyed iron powder is heated together with alloying elements, such as copper and molybdenum, in a reducing atmosphere at a temperature below the melting point to cause partially alloying and agglomeration of the particles. The heating is discontinued before complete alloying and the obtained agglomerate is ground to a desired size. Also the GB patent GB1595346, 1976, (Gustavsson), discloses a diffusion-bonded powder. The powder is prepared from a mixture of an iron powder and a powder of copper or easily reducible copper compounds. The patent application discloses an iron-copper powder having a content of 10% by weight of diffusion bonded copper. This master powder is diluted with plain iron powder and the resulting copper content in the powder composition is 2% respective 3% by weight of the powder composition.

Examples of other patent documents disclosing various copper containing diffusion bonded iron or iron-based powders are JP3918236B2 (Kawasaki), JP63-114903A (Toyota), JP8-092604 (Dowa), JP1-290702 (Sumitomo).

The Kawasaki patent document describes a manufacturing method for manufacturing a diffusion bonded powder where atomized iron powder having an oxygen content of 0.3-0.9% and a carbon content less than 0.3% is mixed with a coarse metal copper powder having an average particle size of 20-100 μm.

The Toyota patent application discloses a highly compressible metal powder consisting of a pre-alloyed iron powder having particles of copper diffusion bonded to its surfaces. The pre-alloyed iron powder is composed of 0.2-1.4% Mo, 0.05-0.25% Mn and less than 0.1% C, all percentage by weight of the pre-alloyed iron powder. The pre-alloyed iron powder is mixed with copper powder or copper oxide powder having a weight average particle size of at most ⅕ of the weight average particle size of pre-alloyed iron powder, the mixture is heated whereby the copper particles are diffusion bonded to the pre-alloyed iron powder. The copper content of the resulting diffusion bonded powder is 0.5-5% by weight.

In the Dowa patent application, it is described a manufacturing method for producing a diffusion bonded copper containing iron powder wherein fin particulate copper oxide powder having a particle size of at most 5 μm and a specific surface area of at least 10 $m^2/g$, is mixed with an iron containing powder. The mixture between the copper oxide powder and the iron containing powder is further subjected to a reducing atmosphere at a temperature between 700-950° C. to reduce and deposit metallic copper or the iron powder surface at a content of 10-50% by weight of the resulting diffusion bonded powder.

The Sumitomo document discloses a diffusion alloyed iron powder having good compressibility suitable to be used for manufacturing compacted and sintered components having high strength, high toughness and excellent dimensional stability, without the need of using nickel as an alloying element. The diffusion alloyed powder is produced by mixing atomized iron powder with iron oxide powder, at a content of 2-35% by weight of the iron powder, and copper powder and optionally molybdenum powder. The mixture is subjected to a reduction heat treatment process whereby the alloying elements and the reduced iron oxide is diffusion bonded to the surface of the atomized iron powder. The amount of copper in the resulting diffusion bonded powder is 0.5-4% by weight.

Although many attempts have been in order to find a cost-effective diffusion-bonded cooper containing iron powder for manufacturing pressed and sintered components, there is still a need for improving such powder with respect of cost and performance.

SUMMARY

The present invitation discloses a new diffusion-bonded powder consisting of an iron powder having 1-5%, preferably 1.5-4% and most preferably 1.5-3.5% by weight of copper particles diffusion bonded the surfaces of the iron powder particles. The present invention also discloses a method for producing the diffusion-bonded powder as well as a method for manufacture of a component from the new diffusion-bonded powder and the produced component.

DETAILED DESCRIPTION

Iron Powder

The iron powder used to produce the diffusion bonded powder is an atomized iron powder, and in a preferred embodiment having an oxygen content of 0.3-1.2%, preferably 0.5-1.1% by weight, and a content of carbon of 0.1-0.5% by weight. In one embodiment the content of oxygen is 0.5-1.1% by weight and the content of carbon is above 0.3% by weight and up to 0.5% by weight. When water atomizing an iron melt it is more economical to allow higher contents of oxygen and carbon why this embodiment is preferred from a production economical point of view.

In an alternative embodiment the oxygen content is at most 0.15% by weight and the carbon content is at most 0.02% by weight.

By using an iron powder having a defined oxygen content, it has surprisingly been shown that the adhesion of the copper particles to the iron powder after the diffusion bonding-, reduction heat treatment-, process is significantly improved.

The maximum particle size of the iron powder is typically 250 μm and at least 75% by weight is below 150 μm. At most 30% by weight is below 45 μm. The particle size measured according to ISO4497 1983.

The total content of other unavoidable impurities, such as Mn, P, S, Ni and Cr is at most 1.5% by weight.

Copper Containing Powder

The copper containing powder used to produce the diffusion bonded powder is cuprous oxide, ($Cu_2O$) or cupric oxide (CuO), preferably cuprous oxide is used. The copper containing powder has a maximum particle size, $X_{90}$, of 22 μm, here defined as at least 90% of the particles are below the maximum particle size, and a weight average particle size, $X_{50}$, of at most 15 μm, preferably at most 11 μm, determined with laser diffractometry according to ISO 13320: 2003.

Diffusion-Bonded Powder

The iron powder is mixed with copper containing powder in proportions to obtain the final content of copper in the diffusion-bonded powder. After thoroughly mixing the powders, the mixture is subjected to a reduction-annealing process in a reducing atmosphere containing hydrogen at atmospheric pressure and at a time and temperature sufficient to reduce the copper containing powder into metallic copper and simultaneously allow copper to partially diffuse into the iron powder. Typically, the holding temperature is 800-980° C. for a period of 20 minutes to 2 hours. The obtained material after the reduction-annealing process is in form of a loosely bonded cake which after a cooling step is subjected to crushing or gentle grinding followed by classifying yielding the final powder. The maximum particle size of the obtained diffusion-bonded powder is 250 μm and at least 75 by weight is below 150 μm. At most 30% by weight is below 45 μm. The particle size measured according to ISO 4497 1983.

The oxygen content in the new powder is at most 0.16% by weight and the amount of other inevitable impurities is at most 1% by weight.

The apparent density of the new powder, AD, as measured according to ISO 3923:2008 is at least 2.70 $g/cm^3$ in order to obtain sufficiently high green density and consequently sintered density at production of components.

The diffusion bonded powder is characterized by having a degree of bonding of copper to the iron-based powder with a SSF-factor of at most 2, as measured by the SSF method. It has also surprisingly been shown that when the oxygen content of the iron powder used for production of the new powder is between 0.3-1.2% by weight, the SSF-factor is at most 1.7.

The SSF method is here defined as a method for determine the degree of bonding of copper to the iron or iron-based powder by separating the diffusion bonded powder into two fractions, one fraction having a particle size below 45 μm and another fraction having a particle size of 45 μm and above. This separation may be performed with a 45 μm standard sieve (325 mesh). The procedure according to ISO 4497:1986 may be followed with the proviso that only one sieve, 45 μm, is used. The quotation between the copper content in the finer fraction which passes the 45 μm sieve, and the copper content in the coarser fraction which do not passes the 45 μm sieve, gives a value, degree of bonding or SSF-factor.

SSF-factor=weight % Cu in the finer fraction, (−45 μm)/weight % Cu in the coarser fraction, (45 μm and above).

The copper content in the fractions are determined by standard chemical methods with at least an accuracy of two figures.

Another distinguishing characterization of the new powder is that it enables production of sintered component characterized by having a minimum of variation of the nominal copper content, within each individual component as well as between the components. This can be expressed as that the maximum copper content in a cross section of a sintered component, produced at specified production conditions, should be at most 100% higher than the nominal copper content.

The samples for measuring variations in the copper content, maximum and minimum copper content, pore sizes and pore area are prepared according to the following;

A copper containing diffusion bonded powder according to the present invention is mixed with 0.5% of graphite, having a particle size, X90, of at most 15 μm measured with laser diffraction according to ISO 13320:1999, and 0.9% of the lubricant described in the patent publication WO2010-062250, wherein the description of the lubricant described in the patent publication WO2010-062250 is incorporated herein by reference. The obtained mixture is transferred into a compaction die for production of tensile strength samples (TS-bars) according to ISO 2740: 2009 and subjected to a compaction pressure of 600 MPa. The compacted sample is thereafter ejected from the compaction die and subjected to a sintering process at 1120° C. for a period of time of 30 minutes in an atmosphere of 90% nitrogen/10% hydrogen at atmospheric pressure.

A particulate composite lubricant particle may comprise a core of 10-60% by weight of at least one primary fatty acid amide having more than 18 and not more than 24 carbon atoms and 40-90% by weight of at least one fatty acid bisamide, said lubricant particle also comprising nanoparticles of at least one metal oxide adhered on the core.

The maximum copper content is measured in a cross section of the sintered component, i.e. a cross section perpendicular to the longest extension of the sintered TS-bar, through line scanning in a Scanning Electron Microscope (SEM) equipped with a system for Energy Dispersive Spectroscopy (EDS). The magnification is 130×, working distance is 10 mm and the scanning time is 1 minute.

The maximum copper content, measured by the above-mentioned method, is at any point along the line at most 100% higher than the nominal copper content. It has also surprisingly been shown that when the oxygen content of the iron powder used for production of the new powder is between 0.3-1.2% by weight, the maximum copper content, measured by the above-mentioned method, is at any point along the line at most 80% higher than the nominal copper content and no measurements show 0% copper.

Alternatively, or in addition to the above-mentioned variation of copper content, a distinguishing characterization of the new powder is that it enables production of sintered component characterized by exhibiting a maximum size of the largest pore. This can be expressed as that the maximum pore area in a cross section of a sintered component, produced at the specified production conditions as described earlier, is at most 4000 $\mu m^2$.

The pore size analysis is carried out on a Light Optical Microscope (LOM) at a magnification of 100× with the aid of a digital video camera and a computer based software. The total measured area is 26.7 $mm^2$. The software is operating in black and white mode and detects pores using "detection of black area in measured area", where black area is equal to pores.

The following definitions is applied:

Largest pore length: The largest length of all pores in the fields

Largest pore area: The area of the largest pore from those measured in the fields.

Manufacture of Sintered Component

Before compaction, the diffusion-bonded powder is mixed with various additives such as lubricants, graphite, and machinability enhancing additives.

Thus, an iron-based powder composition according to the invention contains or consists of 10 to 99.8 weight % of the diffusion bonded powder according to the invention, optionally graphite up to 1.5% weight % and when graphite is present the content is 0.3-1.5 weight %, preferably 0.15-1.2 weight %, 0.2 to 1.0 weight % of lubricant and up to 1.0 weight % of machinability enhancing additives, balanced with iron powder.

In one embodiment, an iron-based powder composition according to the invention contains or consists of 50 to 99.8 weight % of the diffusion bonded powder according to the invention, optionally graphite up to 1.5% weight % and when graphite is present the content is 0.3-1.5 weight %, preferably 0.15-1.2 weight %, 0.2 to 1.0 weight % of lubricant, up to 1.0 weight % of machinability enhancing additives, balanced with iron powder.

After addition and admixing of additives the obtained mixture is subjected to a compaction process at a compaction pressure of at least 400 MPa, the subsequently ejected green component is sintered in a neutral or reducing atmosphere at a temperature of about 1050-1300° C. for a period of time of 10 to 75 minutes. The sintering step may be followed by a hardening step, such as case hardening, through hardening, induction hardening, or a hardening process including gas or oil quenching.

FIGURE LEGENDS

Figure 2:
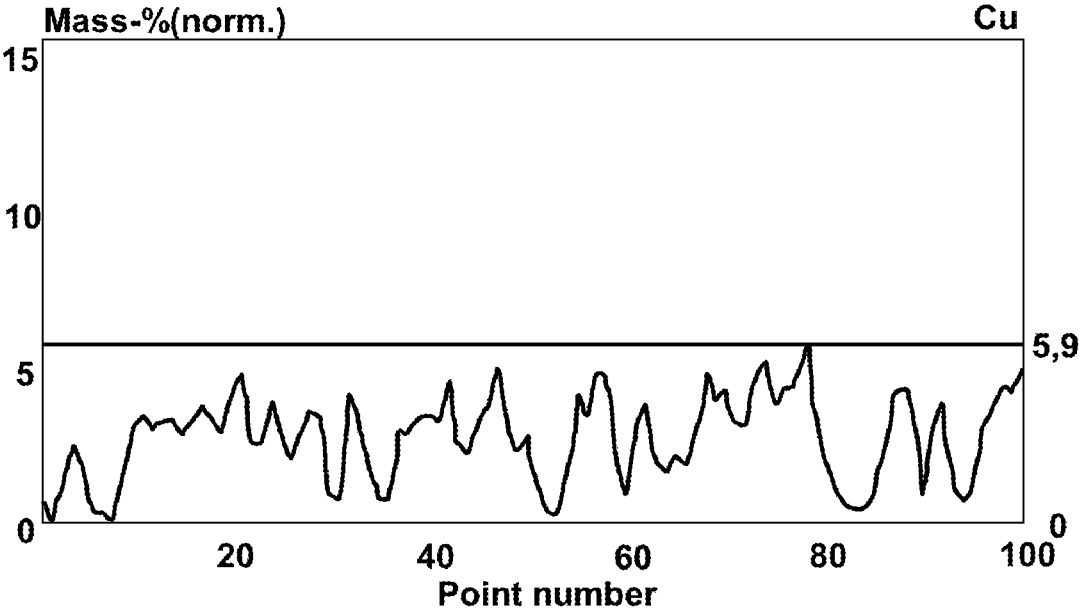
Figure 3:
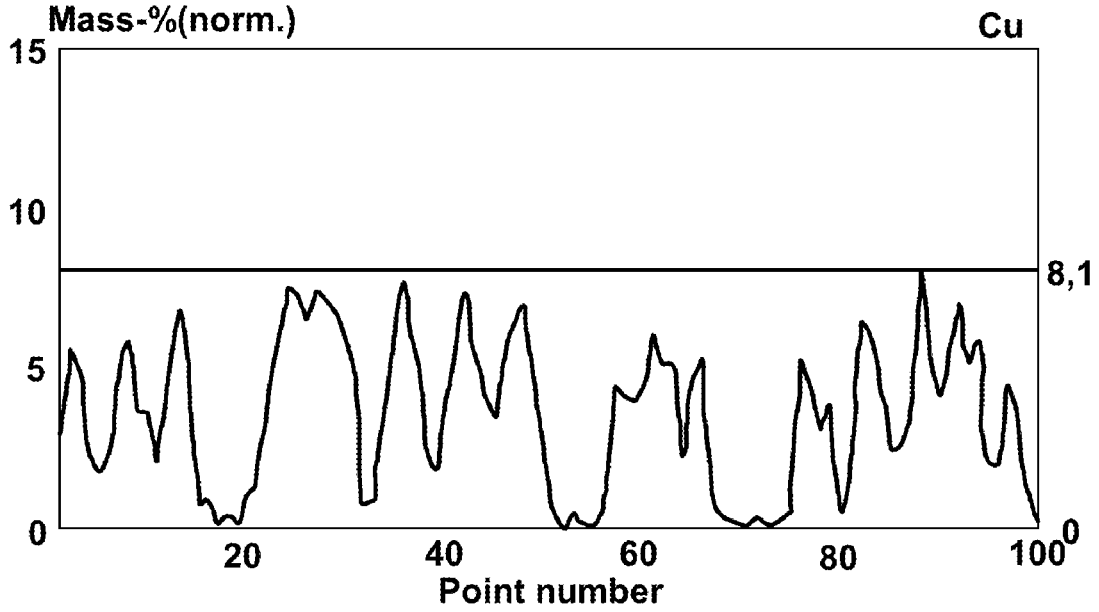
Figure 4:
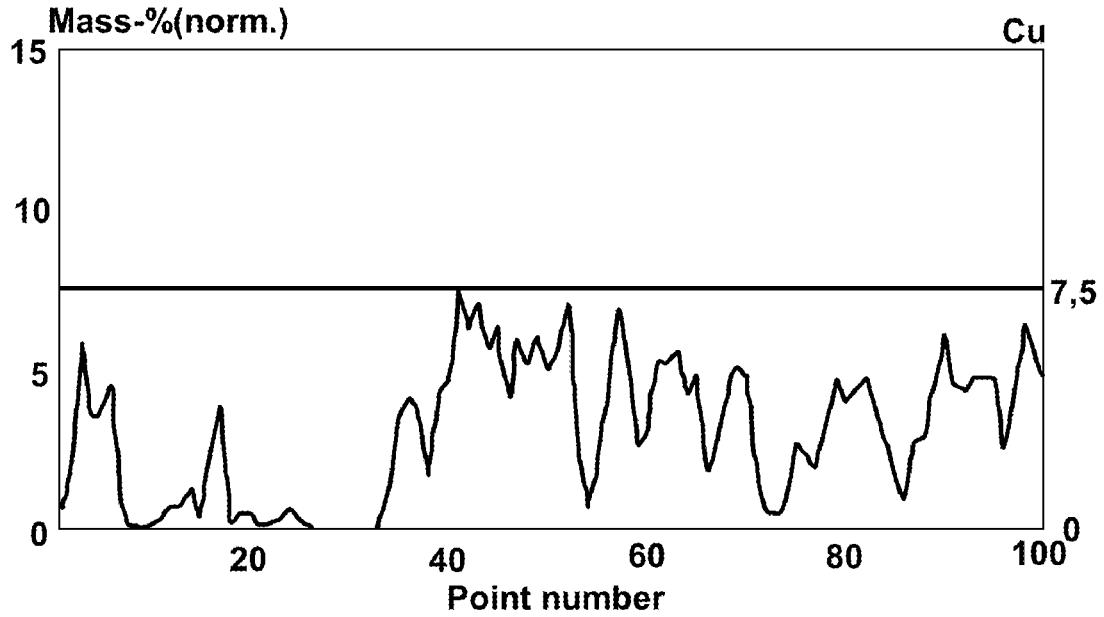
Figure 5:
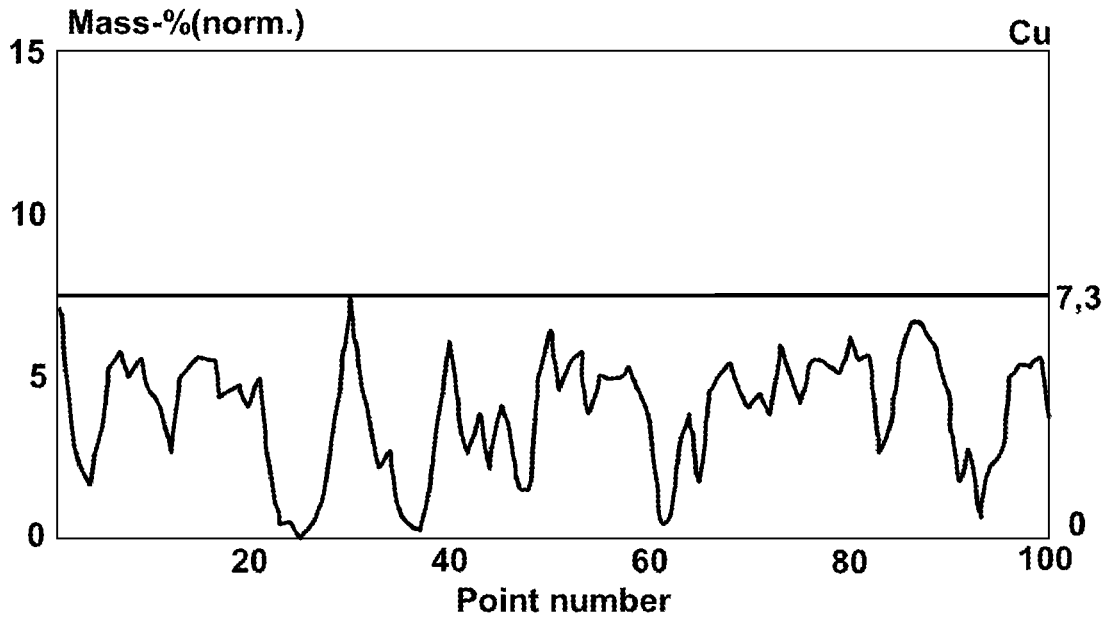

FIG. 1 shows variation in copper content for sample ac.
FIG. 2 shows variation in copper content for sample bc.
FIG. 3 shows variation in copper content for sample bd.
FIG. 4 shows variation in copper content for sample be.
FIG. 5 shows variation in copper content for sample ad.

EXAMPLES

Example 1

Various diffusion-bonded powders were produced by mixing iron powders according to table 1 with copper containing powders according to table 2 in an amount sufficient to yield a content of 3% of copper in the subsequently obtained diffusion-bonded powder. The obtained mixtures were subjected to a reduction-annealing process at a temperature of 900° C. in a reducing atmosphere for a period of time 60 minutes. After the reduction-annealing process the obtained loosely sintered cake was gently crushed to a powder having a maximum particle size of 250 μm.

The following tables show raw materials used.

TABLE 1

| Iron powder | | | |
|---|---|---|---|
| Iron powder | O [%] | C [%] | $D_{50}$ [μm] |
| a) | 1.02 | 0.41 | 98 |
| b) | 0.08 | 0.004 | 107 |

TABLE 2

| Copper containing powder | | | | |
|---|---|---|---|---|
| Copper containing powder | Cu [%] | O [%] | $D_{50}$ [μm] | $D_{95}$ [μm] |
| c) $Cu_2O$ | 88.1 | Not measured | 15 | 22 |
| d) Cu 100 | 99.5 | 0.18 | 85 | 160 |
| e) Cu 200 | 99.6 | 0.15 | 60 | 100 |

The obtained diffusion bonded powders were designated ac, bc, bd, be, ad and ae according to type of raw materials used.

Determination of SSF-factors for the diffusion bonded powders according to the invention were performed according to the method described in the detailed description. The following results according to table 3 were obtained.

TABLE 3

| SSF-factor | |
|---|---|
| Sample | SSF-factor |
| ac | 1.56 |
| bc | 1.97 |

Samples for measuring maximum pore size, maximum pore area and copper variation were prepared according to the procedure in the detailed description.

The maximum copper content was measured with the aid of a FEG-SEM, type Hitachi SU6600. The EDS system was manufactured by Bruker AXS.

After inserting the specimen in the vacuum chamber and having adjusted the working distance to 10 mm, the electron ray was aligned to use the lowest possible magnification, 130×. The strait scanning line was chosen with as few pores as possible (deep pores could be capturing photons of importance). The scanning time was set to 1 min.

The results are presented in FIGS. 1-6 and in table 4.

The pore size analysis was carried out on a Light Optical Microscope (LOM) at a magnification of 100× with the aid of a digital video camera and a computer based software, Leica QWin. The module in the software called "Largest Pore Measurement" was used. The total measured area is 26.7 $mm^2$ corresponding to 24 measure fields.

All specimens were measured with a horizontal press orientation and a side way stepping of the cross section.

The software was operating in black and white mode and detected pores using "detection of black area in measured area", where black area is equal to pores.

The following table 4 shows the results from the measurements.

| Diffusion bonded powders | | Largest pore length [μm] | Largest pore area [$μm^2$] | Maximum Cu content [%] | % of nominal Cu content | Minimum Cu content [%] |
|---|---|---|---|---|---|---|
| ac | Invention | 144 | 3196 | 5.5 | 183 | 0.7 |
| bc | Invention | 142 | 3130 | 5.9 | 197 | 0.0 |
| bd | Comparative | 199 | 9034 | 8.1 | 270 | 0.0 |
| be | Comparative | 160 | 5128 | 7.5 | 250 | 0.0 |
| ad | Comparative | 178 | 8515 | 7.3 | 243 | 0.0 |
| ae | Comparative | 162 | 5070 | | | |

From table 4 it can be concluded that components made from the diffusion bonded powders according to the invention show smaller largest pore areas and less variation in copper content compared to the comparative examples. It can further be concluded that when iron powder having higher oxygen content is used for producing the diffusion bonded powder according to the invention, the variation of copper content is less compared to when using iron powder having low oxygen content (ac-bc)

Example 2

Four different iron-based powder compositions were prepared by mixing four different copper containing powders at an addition corresponding to 2 weight % copper in the metal powder composition with the atomized iron powder ASC 100.29, available from Höganäs AB, Sweden, 0.5% of synthetic graphite F10 from Imerys Graphite & Carbon, and 0.9% of the lubricant described in the patent publication WO2010-062250.

The copper containing powders used were:

The diffusion bonded powder ac according to Example 1.

Distaloy®ACu, available from Höganäs AB Sweden. Distaoy®ACu is an iron powder having 10% of copper diffusion bonded on the surfaces if the iron powder.

Cu-200, the elementary Cu powder described in table 2.

Cu-100, the elementary Cu powder described in table 2.

The following table 5 shows the copper containing powders used and the content of the ingredients in the metal powder compositions.

TABLE 5

| Iron based powder composition No. | Copper containing powder | Copper containing powder [%] | ASC100.29 [%] | Graphite [%] | Lubricant [%] |
|---|---|---|---|---|---|
| 1 | ac | 66.7 | 31.9 | 0.5 | 0.9 |
| 2 | Distaloy ® ACu | 20 | 78.6 | 0.5 | 0.9 |
| 3 | Cu-200 | 2 | 96.6 | 0.5 | 0.9 |
| 4 | Cu-100 | 2 | 96.6 | 0.5 | 0.9 |

The iron-based powder compositions were compacted into test bars at 700 MPa according to ISO3928. After compaction the ejected green test bars were sintered in an atmosphere of 90/10 $N_2/H_2$ at a temperature of 1120° C. during 30 minutes and cooled to ambient temperature. Thereafter the test bars were subjected to through hardening at 860° C. for 30 minutes at an atmosphere with a carbon potential of 0.5%, followed by quenching in oil.

The heat treated test bars were tested for fatigue strength at R=−1 with a run out limit of $2\times10^6$ cycles according to MPIF standard 56. The endurance limit was determined at 50% probability of survival.

The following table 6 shows the results from the fatigue test.

TABLE 6

| Test bars made from Iron-based powder composition No. | Fatigue strength 50% probability [MPa] |
|---|---|
| 1 | 352 |
| 2 | 328 |
| 3 | 327 |
| 4 | 320 |

Table 6 shows that samples made from an iron-based powder mixture containing the diffusion alloyed powder according to the invention exhibits increased fatigue strength compared to samples made from iron-based powder mixtures containing elemental copper powders or Known copper containing diffusion bonded powders.

The invention claimed is:

1. A process for producing an iron-based powder comprising the following steps:

providing an iron powder having a content of oxygen of 0.3-1.2% by weight, a content of carbon of 0.1-0.5% by weight, a maximum particle size of at most 250 μm and at most 30% by weight below 45 μm and providing a copper containing powder having a maximum particle size, $X_{90}$, of at most 22 μm and a weight average particle size, $X_{50}$, of at most 15 μm, mixing said iron powder and said copper containing powder, subjecting said mixture to a reduction annealing process in a reducing atmosphere at 800-980° C. for a period of 20 minutes to 2 hours to obtain a cake, and crushing the obtained cake and separating a resulting powder by desired particle size to form the iron-based powder.

2. The process according to claim 1, wherein the iron-based powder has a maximum particle size of 250 μm, at least 75% is below 150 μm and at most 30% is below 45 μm, wherein the iron-based powder has an apparent density of at least 2.70 g/cm3 and an oxygen content of at most 0.16% by weight, and wherein other impurities are at most 1% by weight of the iron-based powder.

3. The process according to claim 2, wherein the iron-based powder has a SSF-factor of at most 2.0, wherein the SSF-factor is defined as the quotient between the Cu content in weight % in the fraction of the iron-based powder which passes a 45 μm sieve and the Cu content in weight % in the fraction of the iron-based powder which does not pass a 45 μm sieve.

4. A process for forming a sintered component, the process comprising forming the iron-based powder according to claim 1 and forming the sintered component, wherein a maximum copper content in a cross section of the sintered component made from the iron-based powder is at most 100% higher than a nominal copper content, wherein the sintered component is produced by:

mixing the iron-based powder with 0.5% of graphite, having a particle size, X90, of at most 15 μm measured with laser diffraction according to ISO 13320:1999, and 0.9% of lubricant;

transferring the obtained mixture into a compaction die for production of tensile strength samples (TS-bars) according to ISO 2740: 2009 and subjecting the obtained mixture to a compaction pressure of 600 MPa;

ejecting the compacted sample from the compaction die; and subjecting the compacted sample to a sintering process at 1120° C. for a period of 30 minutes in an atmosphere of 90% nitrogen/10% hydrogen at atmospheric pressure, wherein the maximum copper content is determined through lines scanning in a Scanning Electron Microscope (SEM) equipped with a system for Energy Dispersive Spectroscopy (EDS), wherein the magnification is 130×, working distance is 10 mm and the scanning time is 1 minute.

5. A process for forming a sintered component, the process comprising forming the iron-based powder according to claim 1 and forming the sintered component, wherein a largest pore area in a cross section of the sintered component made from the iron-based powder is at most 4000 $\mu m^2$, wherein the sintered component is produced by:

mixing the iron-based powder with 0.5% of graphite, having a particle size, X90, of at most 15 μm measured with laser diffraction according to ISO 13320:1999, and 0.9% of lubricant;

transferring the obtained mixture into a compaction die for production of tensile strength samples (TS-bars) according to ISO 2740: 2009 and subjecting the obtained mixture to a compaction pressure of 600 MPa;

ejecting the compacted sample from the compaction die; and subjecting the compacted sample to a sintering process at 1120° C. for a period of 30 minutes in an atmosphere of 90% nitrogen/10% hydrogen at atmospheric pressure, wherein the largest pore area is determined in a Light Optical Microscope (LOM) at a magnification of 100× with the aid of a digital video camera and a computer based software and the total measured area is 26.7 $mm^2$.

6. A process for forming a composition, the process comprising forming the iron-based powder according to claim 1 and mixing the iron-based powder with graphite and lubricant to form a composition, the composition comprising:

10 to 99.8 weight % of the iron-based powder;

graphite, in an amount of up to 1.5% weight %;

lubricant, in an amount of 0.3-1.5 weight %; and optionally, at least one machinability enhancing additive, in an amount of up to 1.0 weight %.

7. The process according to claim 6, the composition comprising:

50 to 99.8 weight % of the iron-based powder;

graphite, in an amount of up to 1.5% weight %;

lubricant, in an amount of 0.3-1.5 weight %; and optionally, at least one machinability enhancing additive, in an amount of up to 1.0 weight %.

8. A process for forming a sintered component, the process comprising forming the composition according to claim 6, the process further comprising:

subjecting the composition to a compaction process at a compaction pressure of at least 400 MPa to form a green component;

ejecting the green component;

sintering the green component in a neutral or reducing atmosphere at a temperature of about 1050-1300° C. for a period of 10 to 75 minutes; and optionally, hardening the sintered component in a hardening process, wherein the hardening process is a process selected from case hardening, through hardening, induction hardening, and a hardening process including gas or oil quenching.

9. The process according to claim 8, wherein a maximum copper content in a cross section of the sintered component is at most 100% higher than the nominal copper content, wherein the maximum copper content is determined through lines scanning in a Scanning Electron Microscope (SEM) equipped with a system for Energy Dispersive Spectroscopy (EDS), and wherein the magnification is 130×, working distance is 10 mm and the scanning time is 1 minute.

10. The process according to claim 8, wherein a largest pore area of the sintered component is at most 4000 $\mu m^2$, wherein the largest pore area is determined in a Light Optical Microscope (LOM) at a magnification of 100× with the aid of a digital video camera and a computer based software and the total measured area is 26.7 $mm^2$.

* * * * *